US010390555B2

(12) United States Patent
Fujisawa et al.

(10) Patent No.: US 10,390,555 B2
(45) Date of Patent: Aug. 27, 2019

(54) MANUFACTURING METHOD OF COMPOSITION ELEMENT OF ITEM INCLUDING FLAVOR COMPONENT, AND COMPOSITION ELEMENT OF ITEM, INCLUDING FLAVOR COMPONENT

(71) Applicant: JAPAN TOBACCO INC., Tokyo (JP)

(72) Inventors: Yoshinori Fujisawa, Tokyo (JP); Takuma Nakano, Tokyo (JP); Kimitaka Uchii, Tokyo (JP); Manabu Takeuchi, Tokyo (JP); Kazuhiko Katayama, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 86 days.

(21) Appl. No.: 14/921,861

(22) Filed: Oct. 23, 2015

(65) Prior Publication Data

US 2016/0073678 A1 Mar. 17, 2016

Related U.S. Application Data

(63) Continuation of application No. PCT/JP2014/061617, filed on Apr. 24, 2014.

(30) Foreign Application Priority Data

Apr. 25, 2013 (JP) ..... 2013-092942

(51) Int. Cl.
*A24B 15/24* (2006.01)
*A24B 15/26* (2006.01)
(Continued)

(52) U.S. Cl.
CPC ..... *A24B 15/24* (2013.01); *A24B 13/00* (2013.01); *A24B 15/167* (2016.11); *A24B 15/241* (2013.01); *A24B 15/26* (2013.01)

(58) Field of Classification Search
CPC ..... A24B 15/24; A24B 15/26
(Continued)

(56) References Cited

U.S. PATENT DOCUMENTS 1,538,265 A * 5/1925 Arnold ..... C07D 401/04 202/175
1,671,259 A * 5/1928 Schloesing ..... A24B 15/24 131/297
(Continued)

FOREIGN PATENT DOCUMENTS

EP 0374779 A2 6/1990
GB 242225 A * 4/1926 ..... A24B 15/243
(Continued)

OTHER PUBLICATIONS

Canadian Office Action and Search Report, dated Sep. 19, 2016, for Canadian Application No. 2,910,389.
(Continued)

*Primary Examiner* — Eric Yaary
*Assistant Examiner* — Russell E Sparks
(74) *Attorney, Agent, or Firm* — Birch, Stewart, Kolasch & Birch, LLP

(57) ABSTRACT

The production process comprises a step (A) in which an alkali-treated tobacco source is heated to make the tobacco source release a flavoring ingredient into a gas phase, a step (B) in which the flavoring ingredient released into the gas phase is brought into contact with a given solvent which is a liquid substance at ordinary temperature, thereby trapping the flavoring ingredient in the given solvent, and a step (C) in which the given solvent is added to a constituent element.

8 Claims, 7 Drawing Sheets

(51) Int. Cl.
*A24B 13/00* (2006.01)
*A24B 15/16* (2006.01)

(58) Field of Classification Search
USPC ..... 131/297
See application file for complete search history.

(56) References Cited

U.S. PATENT DOCUMENTS 3,298,378 A * 1/1967 Stevens ..... A24B 15/12 131/352
3,424,171 A 1/1969 Rooker
3,612,066 A * 10/1971 Jones ..... A24B 15/26 131/298
3,803,004 A 4/1974 Egri
3,920,750 A * 11/1975 Katzen ..... B01D 3/22 568/432
4,150,677 A * 4/1979 Osborne, Jr. ..... A24B 15/24 131/275
4,215,706 A 8/1980 Larson et al.
5,016,654 A * 5/1991 Bernasek ..... A24B 15/24 131/275
5,038,802 A 8/1991 White et al.
5,060,669 A 10/1991 White et al.
5,080,764 A * 1/1992 Kester ..... C08G 69/12 204/165
5,131,414 A * 7/1992 Fagg ..... A24B 15/24 131/297
5,235,992 A 8/1993 Sensabaugh, Jr.
5,445,169 A 8/1995 Brinkley et al.
5,501,238 A * 3/1996 Von Borstel ..... A24D 3/061 131/331
7,560,031 B1 * 7/2009 Astley ..... C02F 1/441 210/710
8,887,737 B2 11/2014 Howell et al.
2006/0037620 A1 * 2/2006 Thompson ..... A24B 15/00 131/297
2007/0023058 A1 2/2007 Howell et al.
2010/0069477 A1 * 3/2010 Itoh ..... A61K 8/97 514/456
2014/0014584 A1 * 1/2014 Cone ..... C02F 9/00 210/652

FOREIGN PATENT DOCUMENTS

JP 3-259074 A 11/1991
JP 2-238873 A 9/1993
JP 6-98746 A 4/1994
JP 9-10502 A 1/1997
JP 2009-502160 A 1/2009

OTHER PUBLICATIONS

Extended European Search Report dated Dec. 7, 2016, in European Patent Application No. 14788574.3.
Japanese Office Action for Japanese Application No. 2015-513839, dated Jun. 7, 2016, with an English translation.
Notification of First Office Action dated Mar. 3, 2017, in Japanese Patent Application No. 201480023187.5, with English translation.
International Search Report, issued in PCT/JP2014/061617, dated Jun. 17, 2014.
Written Opinion of the International Searching Authority, issued in PCT/JP2014/061617, dated Jun. 17, 2014.
Notification of First Office Action dated Mar. 3, 2017, in Chinese Patent Application No. 201480023187.5, with English translation.
European Office Action, dated Jul. 20, 2018, for European Application No. 14788574.3.
Chinese Office Action for Chinese Application No. 201480023187.5, dated Oct. 11, 2017, with an English translation.
Chinese Office Action, dated Apr. 3, 2018, for Chinese Application No. 201480023187.5, along with an English translation.
Chinese Office Action and Search Report, dated Sep. 28, 2018, for Chinese Application No. 201480023187.5, along with an English translation of the Chinese Office Action.

* cited by examiner

MANUFACTURING METHOD OF COMPOSITION ELEMENT OF ITEM INCLUDING FLAVOR COMPONENT, AND COMPOSITION ELEMENT OF ITEM, INCLUDING FLAVOR COMPONENT

CROSS REFERENCE TO RELATED APPLICATIONS

This application is a Continuation of PCT International Application No. PCT/JP2014/061617, filed on Apr. 24, 2014, which claims priority under 35 U.S.C. 119(a) to Patent Application No. 2013-092942, filed in Japan on Apr. 25, 2013, all of which are hereby expressly incorporated by reference into the present application.

TECHNICAL FIELD

The present invention relates to a manufacturing method of a composition element of an item, including a flavor component, and the composition element of the item including the flavor component.

BACKGROUND ART

Conventionally, as a technique of containing a flavor component (alkaloid including a nicotine component, for example) in a flavor source, there are known a technique of utilizing a tobacco source itself as a flavor source and a technique of extracting a flavor component from the tobacco source so that a flavor source base material is allowed to carry the component.

In the above-described techniques, an impurity component included in the tobacco source may badly affect a smoking flavor, etc., and thus, it is desired to selectively separate/reduce the impurity component only from the tobacco source, however, existing techniques have a problem in that a complicate process is needed, and therefore, easy implementation at low cost is difficult.

CITATION LIST

Patent Literature

Patent Literature 1: U.S. Pat. No. 4,215,706
Patent Literature 2: Japanese Translation of PCT International Application Publication No. 2009-502160
Patent Literature 3: U.S. Pat. No. 5,235,992

SUMMARY OF INVENTION

A first feature of the present invention is summarized as a manufacturing method of a composition element of an item including a flavor component, comprising: a step A of heating a tobacco source which is subjected to an alkaline treatment to release the flavor component from the tobacco source into a vapor phase; a step B of bringing the flavor component released into the vapor phase into contact with a predetermined solvent to trap the flavor component, the predetermined solvent being a liquid substance at room temperature; and a step C of adding the predetermined solvent to the composition element.

A second feature of the present invention is summarized as a composition element of an item including a flavor component characterized by being manufactured by the above manufacturing method.

DESCRIPTION OF EMBODIMENTS

First Embodiment of Present Invention

Figure 1:
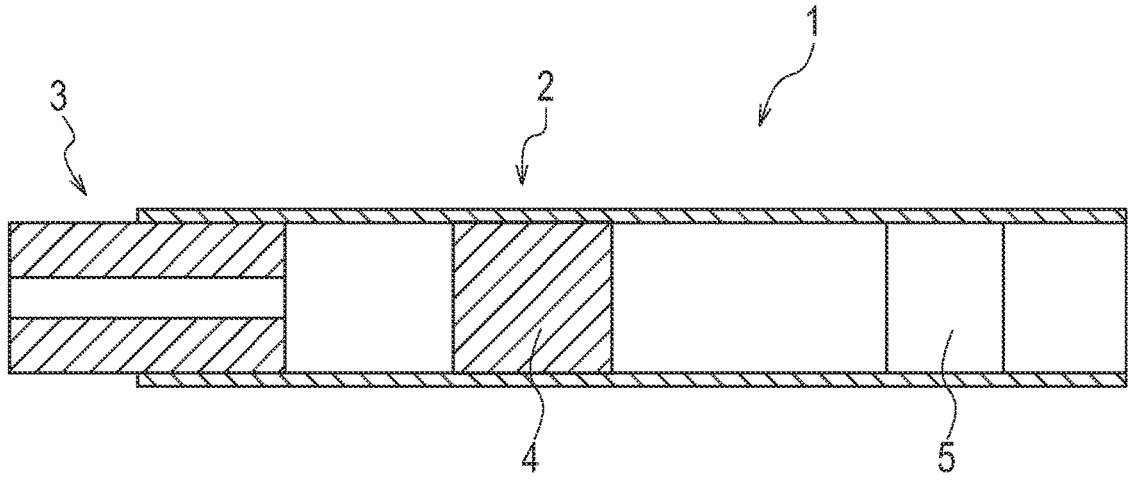
FIG. 1 is a drawing showing an example of an item (tobacco product) manufactured by a manufacturing method according to a first embodiment.
Figure 2:
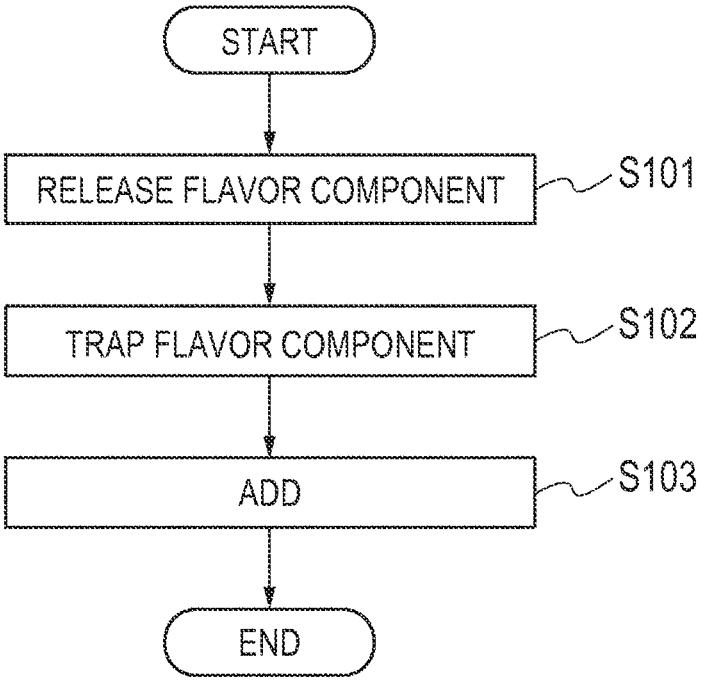
FIG. 2 is a flowchart showing a manufacturing method according to the first embodiment.
Figure 3:
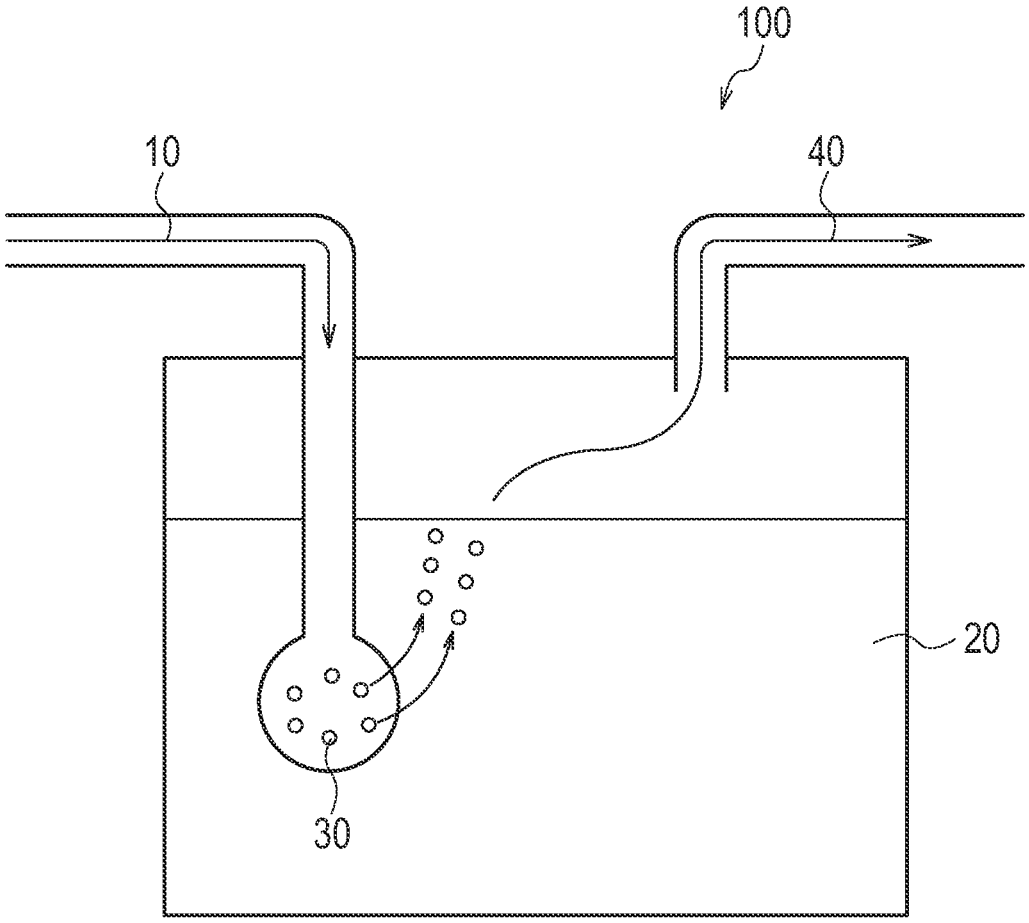
FIG. 3 is a drawing showing an example of a bubbling apparatus for performing bubbling into a predetermined solvent which is performed for a manufacturing method according to the first embodiment.

With reference to FIG. 1 to FIG. 3, a manufacturing method of a composition element of an item including a flavor component according to a first embodiment of the present invention will be described below. In the present embodiment, as the composition element of such an item, a case will be described as an example where a composition element of a flavor inhaler is manufactured.

Such a flavor inhaler may be a flavor inhaler 1 of a carbon heat source type as shown in FIG. 1, a flavor inhaler of an electronic cigarette type, and a flavor inhaler of a chemical reaction type.

It is noted that in the first embodiment, a nicotine component is raised as an example of a flavor component contributing to a tobacco flavor. It should be noted that in the first embodiment, the nicotine component is used as an index of the flavor component.

For example, as shown in FIG. 1, such a flavor inhaler 1 may include: a carbon heat source 3, a flavor source 4, a filter 5, and a paper tube holder 2 that holds the carbon heat source 3, the flavor source 4, and the filter 5.

In the present embodiment, a case will be described as an example in which at least one of the carbon heat source 3, the flavor source 4, the filter 5, and cellulose that configures the paper tube holder 2 is manufactured as the composition element of the flavor inhaler 1.

As shown in FIG. 2, in the manufacturing method according to the present embodiment, in step S101, a tobacco source is subjected to an alkaline treatment (alkaline addition treatment) to release a flavor component from the tobacco source into a vapor phase. In particular, in step S101, the tobacco source subjected to the alkaline treatment is heated to release the flavor component from the tobacco source into the vapor phase. According to such a configuration, it is possible to improve a release efficiency of the flavor component into the vapor phase.

Here, a heating temperature of the tobacco source may be any temperature from a room temperature to a thermal decomposition temperature of the tobacco source, and release efficiency of the flavor component into the vapor phase is increased as the heating temperature is high. However, when the heating temperature is too high, an amount of an impurity component released into the vapor phase may increase. When these are taken into consideration, the heating temperature may be in a range of 60° C. to 150° C., for example. When the heating temperature of the tobacco source is 60° C. or more, it is possible to advance a timing at which a sufficient flavor component is released from the tobacco source. On the other hand, when the heating temperature of the tobacco source is less than 150° C., it is possible to delay a timing at which an impurity component (for example, tobacco-specific N'-nitrosamine: TSNA) is released from the tobacco source.

It is noted that the treatment in step S101 is preferably performed in a sealed space. Here, "sealed" is a state where it is possible to prevent invasion of a solid foreign substance to prevent a loss of contents in normal handling, transportation, or preservation state. According to such a configuration, it is possible to prevent a situation where the flavor component is volatilized to outside the system.

Specifically, as such a tobacco source, a tobacco material or a tobacco extract adjusted to alkaline pH may be used. Preferably, as such a tobacco source, a tobacco material or a tobacco extract of which the pH is adjusted to 8.0 or more, and further preferably, 9.0 or more may be used.

It is noted that the tobacco source may be a tobacco raw material of shredded tobacco, powdery and granular tobacco, a tobacco compact, etc. and may be a tobacco extract such as a sheet to which an extract liquid including a flavor component is added, a lyophilize power, and a gel.

As the tobacco source, a *Nicotiana* raw material such as *Nicotiana. tabacum* and *Nicotiana. rusutica* may be used. As the *Nicotiana. tabacum*, varieties such as Burley and Flue-cured may be used.

Further, the content of the flavor component in the tobacco source is not particularly limited, however, in view of an amount of the flavor component to be released into the vapor phase, it is preferable that the content of the flavor component in the tobacco source preferable is as much as possible. For example, a tobacco source having the content of the flavor component (here, a nicotine component) is 4 wt % or more may be used. As a result, it is possible to release more flavor component with a small amount of tobacco into the vapor phase.

Further, the particle diameter of the tobacco source may be any particle diameter, however, when the tobacco source having the smallest possible particle diameter is used, a release efficiency of the flavor component into the vapor phase is high. It is noted that when the particle diameter of the tobacco source is too small, it is difficult to handle the tobacco source in a manufacture step. When these are taken into consideration, a tobacco source having a particle diameter of, for example, about 0.5 mm to 1.18 mm may be used.

Further, in the manufacturing method according to the first embodiment, as the tobacco source, that which is subjected to a drying treatment after being harvested (Cured tobacco) may be used and that which is not subjected to a drying treatment (Green tobacco) may be used.

Further, as a substance added to the tobacco source in the above-described alkaline addition treatment, a basic substance such as an aqueous potassium carbonate solution may be sprayed. It is noted that when it is considered that the tobacco source is reutilized, the basic substance to be added is preferably weak-basic.

Further, as described above, the pH of the tobacco source which has been subjected to the alkaline addition treatment is preferably alkaline, is more preferably 8.0 or more, and is still more preferably in a range of 8.9 to 9.7. Therefore, it is preferable to determine an amount of a basic substance such as potassium carbonate to be added to the tobacco source in order to satisfy such a condition.

Further, in step S101, it is preferable that the tobacco source is subjected to a wetting treatment. According to such a configuration, it is possible to improve the release efficiency of the flavor component into the vapor phase. Alternatively, it may be possible that the tobacco source is subjected to the wetting treatment at a stage before being advanced to step S101 to increase the water content in the tobacco source, and then step S101 may be performed, and it may be also possible that, in step S101, when an aqueous solution of a basic substance such as an aqueous potassium carbonate solution is added, the alkaline treatment and the wetting treatment are performed simultaneously.

Here, when the water content contained in the tobacco source is larger, a release efficiency of the flavor component into the vapor phase is higher. It is noted that when the tobacco source reaches a state close to bone dry (specifically, the water content of less than 4 wt %), the release efficiency of the flavor component into the vapor phase is significantly lowered.

Specifically, in order to effectively release the flavor component from the tobacco source into the vapor phase, the water content in the tobacco source after spraying the alkaline substance is preferably 10 wt % or more, and is further preferably 30 wt % or more. An upper limit of the water content in the tobacco source is not particularly limited; however, it is preferably 50 wt % or less in order to effectively heat the tobacco source, for example.

Further, in step S101, the tobacco source may be subjected to an aeration treatment. This makes it possible to increase an amount of the flavor component released into the vapor phase from the tobacco source which is subjected to the alkaline treatment. An aeration time in such an aeration treatment differs depending on each device for treating the tobacco source and each amount of the tobacco source, and thus, it is not possible to generalize it, however, for example, when the tobacco source is 500 g of tobacco raw material, the aeration time is within about 300 minutes. Further, a total amount of aeration in such an aeration treatment also differs depending on each device for treating the tobacco source or each amount of tobacco source, and thus, it is not possible to generalize it, however, for example, when the tobacco source is 500 g of tobacco raw material, the ratio of the total amount of aeration relative to the weight of the tobacco source is about 10 L/g. Further, when the tobacco source is 55 g of tobacco raw material, the aeration time is within about 300 minutes, and the total amount of aeration in such an aeration treatment is about 4.9 to 5.3 L/g.

Further, when the water content in the aerated gas increases, it is possible to improve a release efficiency of the flavor component into the vapor phase. For example, a humidified air with the moisture content of about 80% or a saturated steam at 80° C. may be contacted with the tobacco source.

It is noted that the air used in the aeration treatment may be other than a saturated steam. The water content in the air used in the aeration treatment does not particularly need to humidify the tobacco raw material 50, and for example, the moisture contained in the tobacco raw material 50 to which the heating treatment and the aeration treatment are applied may be adjusted to stay in a range of less than 50%. The gas used in the aeration treatment is not limited to the air, may be an inactive gas such as nitrogen and argon.

In step S102, the flavor component released into the vapor phase is trapped by bringing it into contact with a predetermined solvent.

Specifically, the flavor component released into the vapor phase is solved into the predetermined solvent, the flavor component released into the vapor phase is absorbed into the predetermined solvent, and the flavor component released into the vapor phase is adsorbed on the predetermined solvent, for example.

Here, it is preferable that the flavor component released into the vapor phase is aerated (bubbled) into the predetermined solvent to trap the flavor component into the predetermined solvent. This makes it possible to transfer a sufficient amount of the flavor component into the predetermined solvent while restraining an unnecessary impurity substance included in a tobacco raw material as the tobacco source from transferring into the predetermined solvent.

Further, examples of such a predetermined solvent include any substance in a liquid form at room temperature such as glycerin, water, ethanol, polyol, an aqueous solution of citric acid, or oils such as medium chain fatty acid triglyceride. According to such a configuration, it is possible to solve the flavor component into the predetermined solvent.

Here, in step S101 and step S102, a temperature of the predetermined solvent at the time of starting the bubbling is a room temperature. Here, a lower limit of the room temperature is a temperature at which the predetermined solvent does not solidify, preferably 10° C. An upper limit of the room temperature is 40° C. or less, for example. When the temperature of the predetermined solvent is 10° C. or more and 40° C. or less, it is possible to effectively remove a volatile impurity component such as ammonium ion and pyridine from a predetermined solution while restraining volatilization of the flavor component from the predetermined solution.

Further, in step S101 and step S102, the pressure inside a container of an alkaline treatment apparatus is a normal pressure or less. In particular, an upper limit of the pressure inside the container of the alkaline treatment apparatus is +0.1 MPa or less in terms of gauge pressure. Further, the inside of the container of the alkaline treatment apparatus may be a reduced pressure atmosphere. That is, in step S101 and step S102, the flavor component from the tobacco source is released into the vapor phase, and the flavor component released into the vapor phase is trapped by the predetermined solvent, in a state where a pressure of the normal pressure or less is applied to the tobacco source.

Further, the pH of the above-described predetermined solvent is preferably equal to or less than the pH of the above-described tobacco source. According to such a configuration, it is possible to distribute the flavor component in a vapor phase more to the predetermined solvent than to the tobacco source.

FIG. 3 shows an example of a bubbling apparatus 100 for bubbling the flavor component released into the vapor phase in the predetermined solvent.

As shown in FIG. 3, in step S101, a gas 10 including the flavor component released into the vapor phase is released in the predetermined solvent 20 via a hole 30 arranged in the bubbling apparatus 100, and the flavor component in the gas 10 is trapped by the predetermined solvent 20.

The gas 10 including an impurity component not trapped by the predetermined solvent 20 is discharged outside the bubbling apparatus 100. That is, a pressure applied to the predetermined solvent 20 in step S102 is less than normal pressure.

According to such a configuration, it is possible to increase a contact area between the gas 10 and the predetermined solvent 20 and it is possible to improve an efficiency of trapping the flavor component by the predetermined solvent.

Here, in such a bubbling, in order to restrain a rise in temperature of the predetermined solvent, such a predetermined solvent may be cooled. According to such a configuration, it is possible to improve an efficiency of trapping the flavor component by the predetermined solvent. In other words, it is preferable to maintain the temperature of the predetermined solvent at room temperature. A lower limit of the room temperature is a temperature at which the predetermined solvent does not solidify, for example, as described above, preferably 10° C. An upper limit of the room temperature is 40° C. or less, as described above, for example. When the temperature of the predetermined solvent is maintained at 10° C. or more and 40° C. or less, it is possible to effectively remove a volatile impurity component such as ammonium ion and pyridine from the predetermined solution while restraining volatilization of the flavor component from the predetermined solution.

Further, in such a bubbling, a raschig ring may be arranged to increase the contact area of the flavor component released into the vapor phase relative to the predetermined solvent.

Further, in such a bubbling, in order to restrain revolatilization of the flavor component trapped into the predetermined solvent, any acid such as malic acid and citric acid may be added to the predetermined solvent.

Here, it is preferable to dispose less amount of a substance capable of trapping the flavor component between the tobacco source and the predetermined solvent.

It is noted that in order to remove water, etc., trapped together with the flavor component, the predetermined solvent trapping the flavor component may be subjected to a vacuum concentration treatment, a heating concentration treatment, a salting-out treatment, etc. When the vacuum concentration treatment and the heating concentration treatment are performed, a solvent having a steam pressure lower than a component (for example, water) to be removed may be preferably used as a predetermined solvent.

Here, the vacuum concentration treatment is performed in a sealed space, and thus, there is little contact with air and the predetermined solvent needs not be elevated to a high temperature, as a result of which a component may not vary greatly. Therefore, when the vacuum concentration is used, types of available predetermined solvents increase.

In the heating concentration treatment, although there is a concern in degeneration of a liquid such as oxidization of some flavor components, at the same time, it may be possible to obtain an effect of increasing a certain flavor component depending on the type thereof. However, as compared to the vacuum concentration, types of available predetermined solvents decrease. For example, the predetermined solvent having an ester structure such as MCT (Medium Chain Triglyceride) may not be used.

In the salting-out treatment, it is possible to effectively separate the flavor component as compared to the vacuum concentration treatment, however, a yield of the flavor component is poor when the flavor component is half in each liquid solvent phase/water phase. Further, coexistence of a hydrophobic substance (MCT, etc.) is assumed to be required, and thus, salting-out may not occur depending on a ratio among the predetermined solvent, water, and the flavor component.

In step S103, the predetermined solvent trapping the flavor component is added to a composition element of the above-described flavor inhaler 1.

Advantageous Effect

According to the manufacturing method based on the first embodiment, it is possible to transfer a sufficient amount of the flavor component to the predetermined solvent with a very simple method without transferring an unnecessary impurity substance in a tobacco raw material as the tobacco source, and when the predetermined solvent is added to a composition element of the flavor inhaler 1 (for example, a filter) and forms the flavor source, it is possible to reduce the impurity substance to be delivered to a user.

[First Modification]

A first modification of the first embodiment will be described, below. Description proceeds with a particular focus on a difference from the first embodiment, below.

Specifically, although particularly not mentioned in the above-described first embodiment, in the first modification, a predetermined solvent in a state of trapping a flavor component may be poured back to a tobacco raw material (residual tobacco raw material) after the flavor component is released. It should be noted that when the predetermined solvent is poured back, an amount of the flavor component (here, a nicotine component) included in the tobacco raw material obtained after the predetermined solvent is poured back to the residual tobacco raw material is equal to or less than an amount of the flavor component (here, a nicotine component) included in a tobacco raw material obtained before the flavor component is released.

Figure 4:
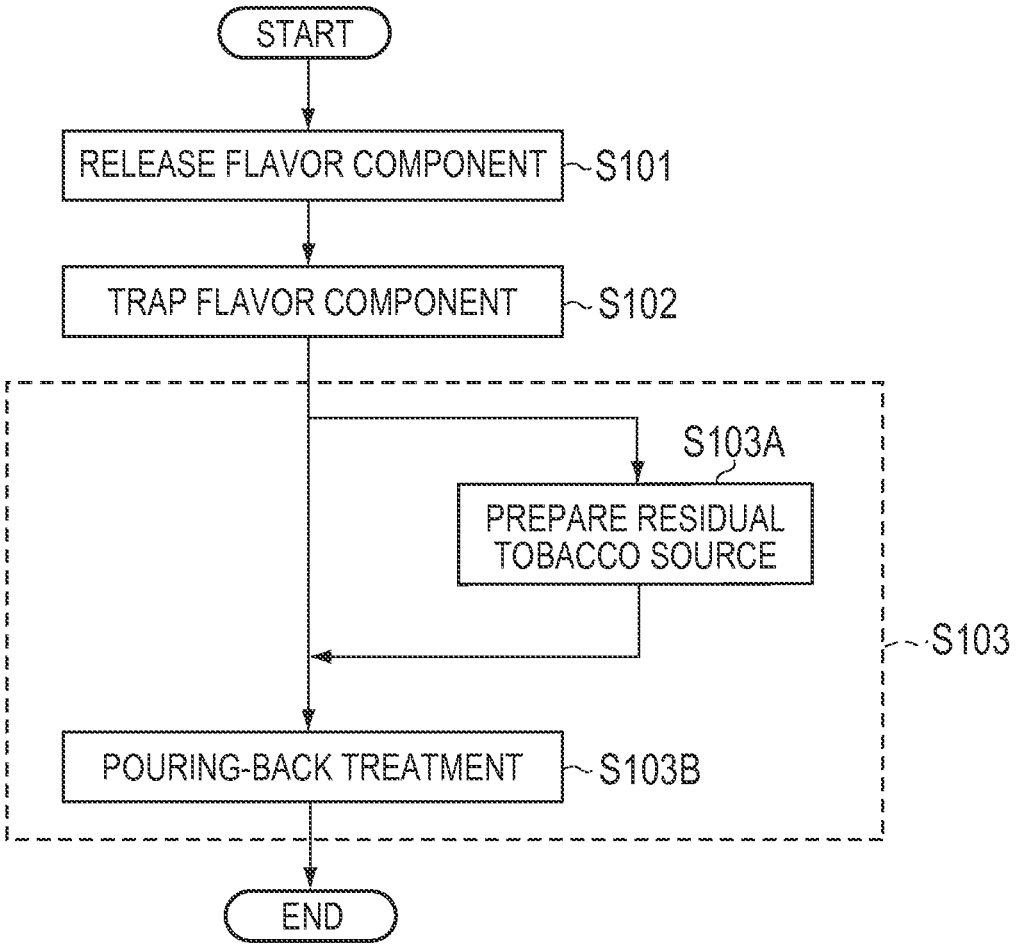
FIG. 4 is a flowchart showing a manufacturing method according to a first modification.

That is, as shown in FIG. 4, a step of adding a predetermined solvent in a state of trapping a flavor component to a composition element (step S103 shown in FIG. 2) includes step S103A and step S103B.

In step S103A, a tobacco raw material (residual tobacco raw material) obtained after the flavor component is released in step S101 is prepared.

In step S103B, the predetermined solvent in a state of trapping the flavor component in step S102 is poured back to the residual tobacco raw material. That is, in the first modification, a composition element of an item including the flavor component is a tobacco raw material (residual tobacco raw material) obtained after the flavor component is released in step S101. It is noted that in step S103B, the predetermined solvent to be poured back to the residual tobacco raw material may be neutralized.

In the first modification, in step S101, it is preferable that the water content in the tobacco raw material before the heating treatment is performed is 30 wt % or more, preferably, 40 wt % or more, and the tobacco source is subjected to the heating treatment until the water content in the tobacco raw material after the heating treatment reaches a state close to bone dry, specifically, until the water content in the tobacco source reaches less than 5 wt %. This makes it possible to sufficiently release an impurity component (for example, ammonium ion) included in the tobacco source, together with the flavor component, into the vapor phase. In other words, it is possible to sufficiently remove the impurity component such as an ammonium ion from the tobacco source. Such a heating treatment method is described in detail in the specification of WO2013/146592, which is incorporated herein by reference.

On the other hand, it is preferable that, in step S102, when the component released into the vapor phase is aerated (bubbled) into the predetermined solvent, the flavor component is trapped by the predetermined solvent. This makes it possible to trap a sufficient amount of the flavor component into the predetermined solvent while restraining the predetermined solvent from trapping an impurity component such as ammonia (ammonium ion), out of the components released into the vapor phase.

Therefore, when a series of treatment steps shown in FIG. 4 by using such a treatment condition are performed, it is possible to manufacture the tobacco raw material in which loss of a flavor component is restrained while removing the impurity component (ammonium ion, etc.) included in the tobacco raw material.

[Second Modification]

In the above-described first embodiment, as the composition element of the item including the flavor component, a case is described where the composition element of the above-described flavor inhaler is manufactured, however, the present invention is not limited to such a case.

That is, the present invention may be imparted to a flavor source base material of items consumable in an oral cavity, such as a gum base, a tablet, an edible film, and a candy, as the composition element of the item including the flavor component.

Alternatively, the present invention may be also applied to a case where as the composition element of the item including the flavor component, instead of the composition element of the above-described flavor inhaler, an aerosol source (so-called E-liquid) of another inhaler such as an electronic cigarette is manufactured. In the embodiment, while a nonvolatile component included in the tobacco source is not transferred to a predetermined solvent, it is possible to collect only a component volatile at about 120° C. in the predetermined solvent, and thus, it is effective when a component collected by the predetermined solvent is used as an aerosol source of an electronic cigarette. This makes it possible to deliver an aerosol including a tobacco flavor to a user while restraining an increase of a volatile impurity component, such as ammonium ion, acetaldehyde, and pyridine, in an electronic cigarette, and it is possible to restrain burning, etc., of a heater for heating an aerosol source. It is noted that the term "electronic cigarette" refers to a non-burning type flavor inhaler or an aerosol inhaler including an electric heater for heating and spraying a liquid aerosol source and an aerosol source to deliver an aerosol to a user (an aerosol inhaler described in U.S. Pat. No. 5,196,673 or an aerosol electronic cigarette described in U.S. Pat. No. 5,385,418, for example).

EXPERIMENT RESULTS

First Experiment

In a first experiment, a collection rate of alkaloid (here, a nicotine component) included in a tobacco source (hereinafter, "nicotine component collection rate), an acetaldehyde concentration, an ammonium ion concentration, a pyridine concentration were measured for Examples and Comparative Example. In Examples, according to the above-described first embodiment, a flavor component was trapped by a predetermined solvent using bubbling (Example 1). Further, the flavor component was trapped under much the same condition as in the Example 1 except that a smaller-scaled device than that in the Example 1 was used in order to equalize an amount of the tobacco source, a treatment time, and an aeration flow rate in step S101 to those in Comparative Example described later, and that temperature control was not performed on a collection solvent (Example 2).

In the Comparative Example, a predetermined solvent was not used but a cold trap was used to trap the flavor component. In particular, in a step of trapping a flavor component that corresponds to step S102, the flavor component was trapped by using a condenser tube obtained by connecting a Liebig condenser tube and a Graham condenser tube. The Liebig condenser tube and the Graham condenser tube respectively used tap water as a refrigerant to maintain the temperatures in the tubes at about 20° C. A component released into the vapor phase from the tobacco source was cooled while the component passed through the Liebig condenser tube and the Graham condenser tube in this order, and a condensed liquid component was collected into a beaker at the exit of the Graham condenser tube, and then the flavor component was trapped.

Conditions of the Examples and the Comparative Example are shown as follows:

Experiment Conditions Relating to Example 1

Type of tobacco source: Burley type of tobacco raw material

Nicotine amount included in tobacco source: 4.9 wt % per dry weight of tobacco source Ammonium ion amount included in tobacco source: 4545 μg/g per dry weight of tobacco source Amount of tobacco source: 500 g Particle diameter of tobacco source: 0.5 mm to 1.18 mm pH of tobacco source after alkaline treatment: 9.6

Initial water content of tobacco source after alkaline treatment: 39%±2%

Heating temperature of tobacco source: 120° C.

Treatment time: 300 min

Air flow amount during bubbling: 15 L/min

Type of predetermined solvent: glycerin

Amount of predetermined solvent: 61 g

Temperature of predetermined solvent: 20° C.

Experiment Conditions Relating to Example 2

Type of tobacco source: Burley type of tobacco raw material—Amount of tobacco source: 55 g Nicotine amount included in tobacco source: 4.9 wt % per dry weight of tobacco source Ammonium ion amount included in tobacco source: 4545 μg/g per dry weight of tobacco source Particle diameter of tobacco source: 0.5 mm to 1.18 mm pH of tobacco source after alkaline treatment: 9.6

Initial water content of tobacco source after alkaline treatment: 39%±2%

Heating temperature of tobacco source: 120° C.

Treatment time: 24 Hr

Air flow amount during bubbling: 1.5 L/min

Type of predetermined solvent: glycerin

Amount of predetermined solvent: 7.4 g

Experiment Conditions Relating to Comparative Example

Type of tobacco source: Burley type of tobacco raw material

Nicotine amount included in tobacco source: 4.9 wt % per dry weight of tobacco source Ammonium ion amount included in tobacco source: 4545 μg/g per dry weight of tobacco source Amount of tobacco source: 55 g Particle diameter of tobacco source: 0.5 mm to 1.18 mm pH of tobacco source after alkaline treatment: 9.6

Initial water content of tobacco source after alkaline treatment: 39%±2%

Heating temperature of tobacco source: 120° C.

Treatment time: 24 Hr

Air flow amount during cold trap: 1.5 L/min

Temperature of refrigerant: 20° C.

Figure 5:
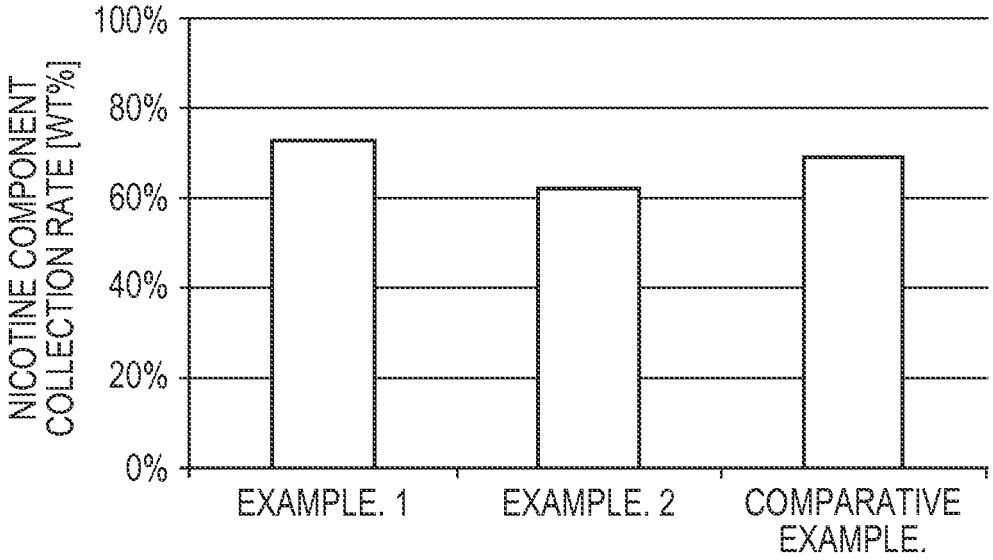
FIG. 5 is a graph for describing a first experiment.

Measurement results of the nicotine component collection rate are as shown in FIG. 5. Further, measurement results of acetaldehyde, ammonium ion, and pyridine trapped by bubbling into the predetermined solvent or condensation by the condenser tube are as shown in FIG. 6 to FIG. 8.

Here, the nicotine component collection rate is indicated in terms of wt % of the nicotine component trapped by the bubbling into the predetermined solvent or condensation by the condenser tube, where an initial weight of the nicotine component included in the tobacco source is 100 wt %. In order to cancel a difference in solvent amount collected in the Examples and the Comparative Example, the acetaldehyde concentration is indicated in terms of a weight ratio relative to a trapped nicotine weight, that is, a weight ratio of the acetaldehyde, where the trapped nicotine weight is 1. Likewise, the ammonium ion concentration and the pyridine concentration are indicated in terms of a weight ratio relative to the trapped nicotine weight, that is, a weight ratio of the ammonium ion and that of the pyridine, where the trapped nicotine weight is 1.

As shown in FIG. 5, in spite of the Example 1 being shorter in treatment time than the Comparative Example, it was confirmed that the nicotine collection rate in the Example 1 was equal to or more than that in the Comparative Example. Further, it was confirmed that the Example 2 that has the same aeration flow amount and treatment time as those in the Comparative Example, acquired the nicotine collection rate approximately equivalent to that in the Comparative Example.

Figure 6:
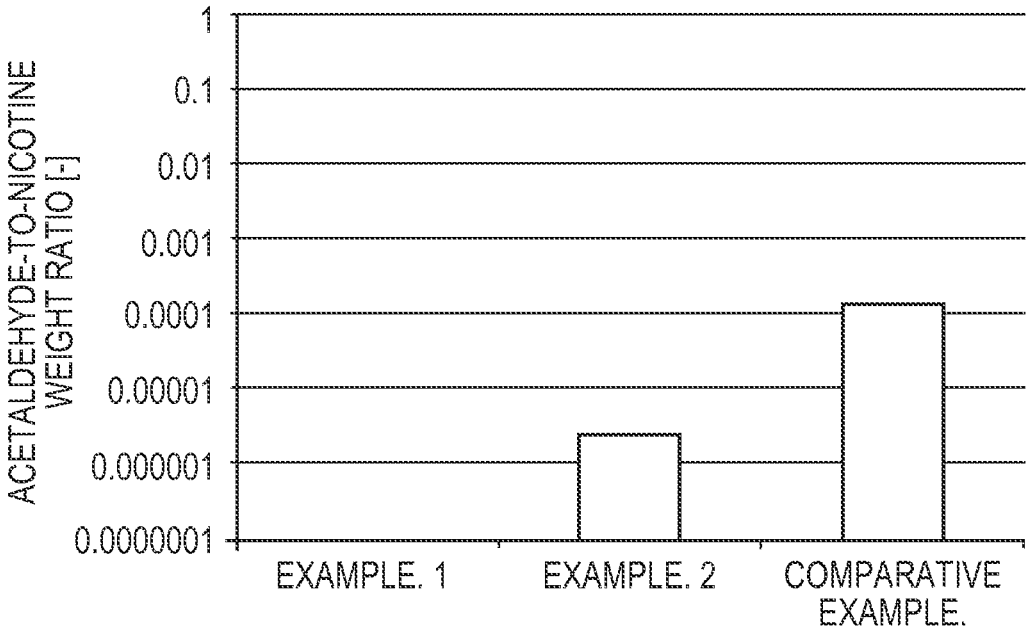
FIG. 6 is a graph for describing the first experiment.
Figure 7:
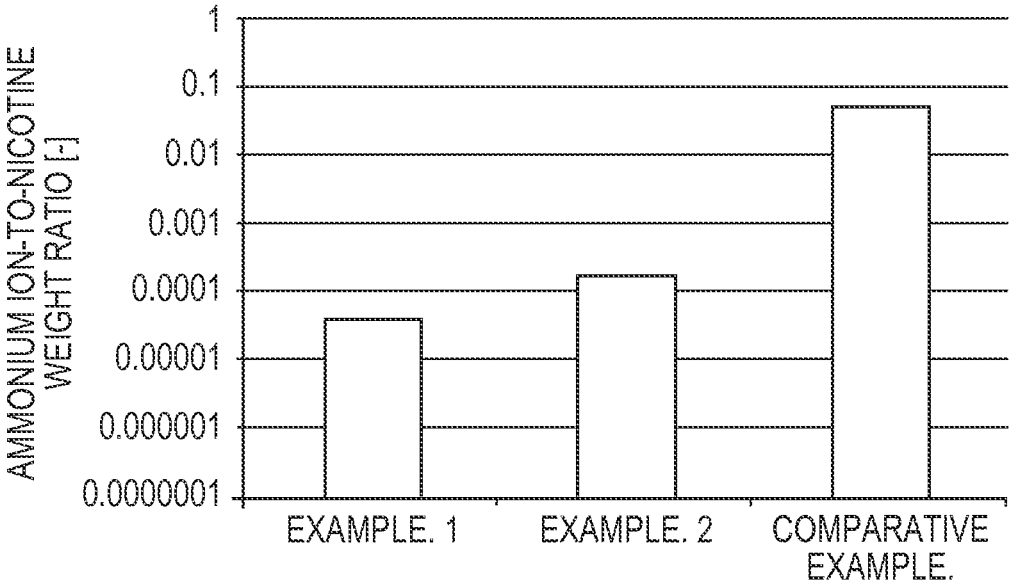
FIG. 7 is a graph for describing the first experiment.
Figure 8:
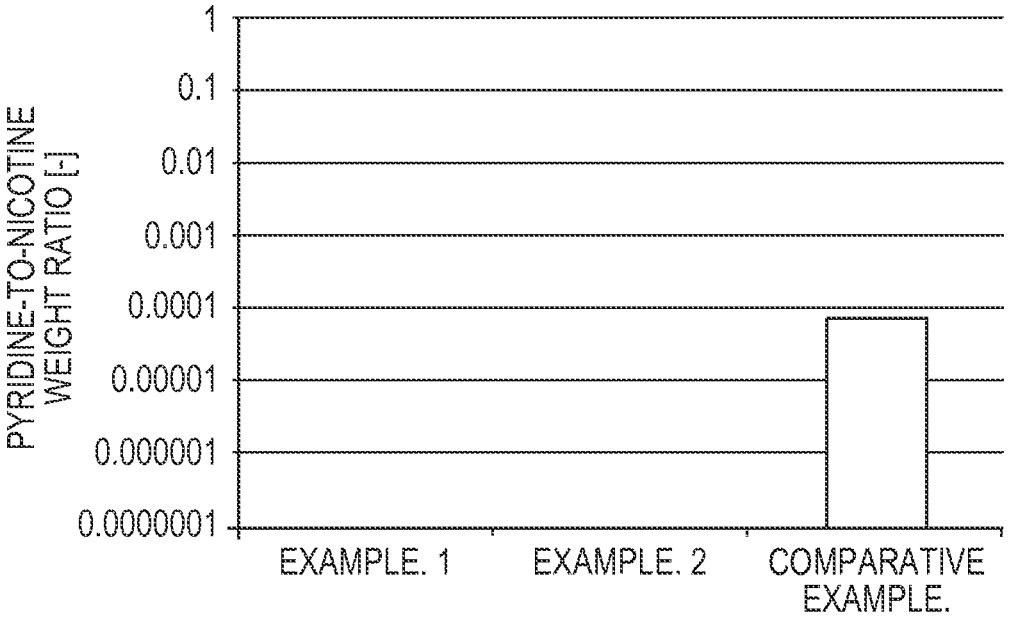
FIG. 8 is a graph for describing the first experiment.

Further, as shown in FIG. 6 to FIG. 8, in the Example 1 and the Example 2, it was confirmed that ratios of acetaldehyde, ammonium ion, and pyridine relative to the nicotine weight were lower than that in the Comparative Example. In particular, in the Example 1, acetaldehyde and pyridine were approximately zero (less than a detection limit), and the weight ratio of the ammonium ion where the nicotine weight was 1 was less than $1/1000$ the Comparative Example. Further, in the Example 2, the pyridine was approximately zero (less than a detection limit), the weight ratio of the acetaldehyde where the nicotine weight was 1 was less than $1/45$ the Comparative Example, and the weight ratio of the ammonium ion where the nicotine weight was 1 was less than $1/270$ the Comparative Example.

Thus, it was confirmed that when the bubbling treatment according to the first embodiment was performed, it was possible to collect the flavor component (here, a nicotine component) while removing an impurity component (for example, acetaldehyde, ammonium ion, and pyridine) included in the tobacco source.

Second Experiment

Figure 9:
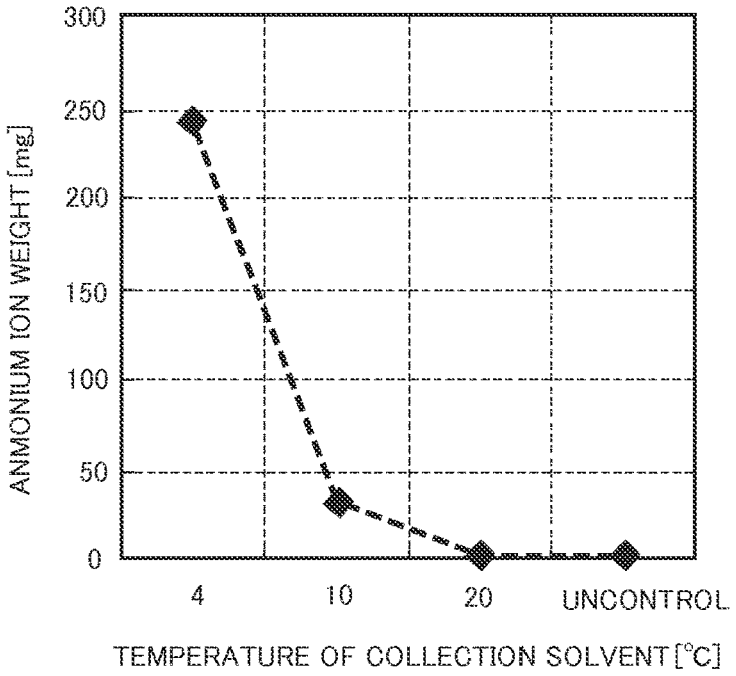
FIG. 9 is a graph for describing a second experiment.
Figure 10:
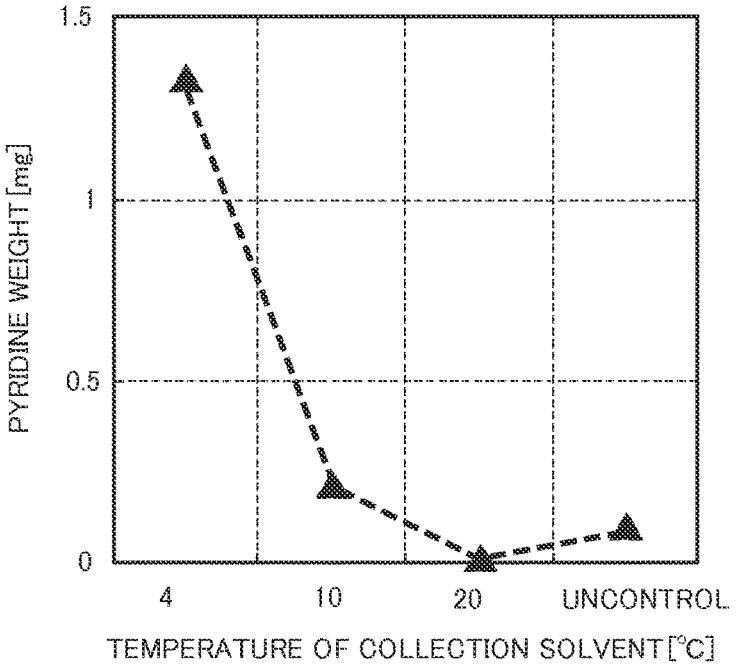
FIG. 10 is a graph for describing the second experiment.

In a second experiment, under the following conditions, when the temperature of the predetermined solvent was changed, the weights of ammonium ion and pyridine included in a predetermined solution were measured. The weight of the ammonium ion included in the predetermined solution is as shown in FIG. 9. The weight of the pyridine included in the predetermined solution is as shown in FIG. 10.

Experiment Conditions

Type of tobacco source: Burley type

Nicotine amount included in tobacco source: 4.9 wt % per dry weight of tobacco source Ammonium ion amount included in tobacco source: 4545 μg/g per dry weight of tobacco source Amount of tobacco source: 500 g Particle diameter of tobacco source: 0.5 mm to 1.18 mm Heating temperature of tobacco source: 120° C.

pH of tobacco source after alkaline treatment: 9.6

Initial water content of tobacco source after alkaline treatment: 39%±2%—Treatment time: 300 min Air flow amount during bubbling: 15 L/min Type of predetermined solvent: glycerin Amount of predetermined solvent: 61 g Firstly, as shown in FIG. 9, it was confirmed that when the temperature of the predetermined solvent was 10° C. or more, it was possible to effectively remove the ammonium ion. On the other hand, it was confirmed that even when the temperature of the predetermined solvent was not controlled, it was possible to effectively remove the ammonium ion. It is noted that the volatilization of the alkaloid (here, a nicotine component) from the predetermined solution was restrained when the temperature of the predetermined solvent was 40° C. or less. In view of these points, when the temperature of the predetermined solvent is set to 10° C. or more and 40° C. or less, it is possible to effectively remove the ammonium ion from the predetermined solution while restraining the volatilization of the nicotine component from the predetermined solution.

Secondly, as shown in FIG. 10, it was confirmed that when the temperature of the predetermined solvent was 10° C. or more, it was possible to effectively remove the pyridine. On the other hand, it was confirmed that even when the temperature of the predetermined solvent was not controlled, it was possible to effectively remove the pyridine. It is noted that the volatilization of the nicotine component from the predetermined solution was restrained when the temperature of the predetermined solvent was 40° C. or less. In view of these points, when the temperature of the predetermined solvent is set to 10° C. or more and 40° C. or less, it is possible to effectively remove the pyridine from the predetermined solution while restraining the volatilization of the nicotine component from the predetermined solution.

It is noted that the temperature of the predetermined solvent is a setting temperature of a chiller (thermostatic bath) that controls a temperature of a container in which the predetermined solvent is housed. It should be noted that the temperature of the predetermined solvent is converged in about 60 minutes after temperature control is started after the container is set to the chiller.

[Measurement Method]

(Measurement Method of Nicotine Component Included in Tobacco Raw Material)

Measurement is performed using a method in accordance with the German Institute for Standardization, DIN 10373. That is, 250 mg of tobacco raw material was taken, and 7.5 mL of 11% sodium hydroxide aqueous solution and 10 mL of hexane were added thereto, which was subjected to shaking extraction for 60 minutes. After the extraction, a hexane phase, which is a supernatant, was supplied to a gas chromatography mass spectrometer (GC/MS), and the nicotine weight included in the tobacco raw material was quantitatively measured.

(Measurement Method of $NH_4^+$ Included in Predetermined Solvent)

50 μL of the predetermined solvent was taken, and 950 μL of 0.05N dilute sulfuric acid aqueous solution was added thereto for dilution, which was analyzed by an ion chromatography after which the ammonium ion included in the predetermined solvent was quantitatively measured.

(Measurement Method of Nicotine Component Included in Predetermined Solvent)

Measurement is performed using a method in accordance with the German Institute for Standardization, DIN 10373. That is, 100 mg of the predetermined solvent was taken, and 7.5 mL of 11% sodium hydroxide aqueous solution and 10 mL of hexane were added thereto, which was subjected to shaking extraction for 60 minutes. After the extraction, a hexane phase, which is a supernatant, was supplied to a gas chromatography mass spectrometer (GC/MS), and the nicotine weight included in the predetermined solvent was quantitatively measured.

(Measurement Method of Acetaldehyde Included in Predetermined Solvent)

0.05 mL of the predetermined solvent was taken, 6 mmol/L of 2,4-dinitrophenyl pyridine solution was added thereto by 0.4 mL to convert the acetaldehyde in the predetermined solvent into a nonvolatile hydrazone derivative, and further, 0.55 mL of 0.2 w/v % trizma base solution was added thereto to stabilize the hydrazone derivative in the predetermined solvent. The resultant liquid was supplied to a high performance liquid chromatography diode array detector to quantitatively measure the hydrazone derivative included in the predetermined solvent. Further, the acetaldehyde amount included in the collection solvent was calculated from the hydrazone derivative amount.

Here, 6 mmol/L of 2,4-dinitrophenyl pyridine solution was prepared by adding 992 mL of water and 8 mL of 80% phosphoric acid to 12 mL of 2,4-dinitrophenyl pyridine-1 L of acetonitrile solution, and 0.2 w/v % trizma base solution was prepared by adding 800 mL of acetonitrile and 200 mL of water to 2 g of trizma base.

(Measurement Method of Pyridine Included in Predetermined Solvent)

1 mL of the predetermined solvent was taken, 19 mL of methanol was added thereto for dilution, and then the pyridine amount included in the predetermined solvent was quantitatively measured using a gas chromatography mass spectrometer.

(Measurement Method of Water Content Included in Tobacco Raw Material)

250 mg of tobacco raw material was taken, and 10 mL of ethanol was added, which was subjected to shaking extraction for 60 minutes. After the extraction, the extracted liquid was filtered through a 0.45 μm membrane filter, which was supplied to a gas chromatography (GC/TCD) including a heat conductivity detector to quantitatively measure the water content included in the tobacco raw material.

It is noted that the weight of the tobacco raw material in a dry state is calculated by subtracting the above-described water content from a total weight of the tobacco raw material.

Thus, the present invention has been explained in detail by using the above-described embodiments, however, it is obvious that for persons skilled in the art, the present invention is not limited to the embodiments explained herein. The present invention can be implemented as modified and changed modes without departing from the gist and the scope of the present invention defined by the claims. Therefore, the description of the specification is intended for explaining the example only and does not impose any limited meaning to the present invention.

INDUSTRIAL APPLICABILITY

According to the present invention, it is possible to provide a manufacturing method of a composition element of an item including a flavor component with can selectively reduce an impurity component included in a tobacco source with a simple and low-cost process, and a composition element of the item including the flavor component.

The invention claimed is:

1. A manufacturing method of a composition element including a flavor component, comprising the steps of:

(a) subjecting a tobacco source to an alkaline treatment;

(b) subjecting the tobacco source to a wetting treatment;

(c) heating the tobacco source subjected to the alkaline treatment and the wetting treatment to release a released component from the tobacco source into a vapor phase;

(d) aerating the released component into a predetermined solvent to trap a flavor component included in the released component and to exhaust an impurity component included in the released component; and (e) adding the predetermined solvent to the composition element, wherein:

the predetermined solvent is a liquid substance at a temperature in a range of 10° C. or more and 40° C. or less; and the impurity component includes any one of pyridine, ammonium ion, and acetaldehyde.

2. The manufacturing method according to claim 1, wherein:

the step (c) includes heating the tobacco source at a range of 60° C. to 150° C.

3. The manufacturing method according to claim 1, wherein:

the predetermined solvent includes any one of glycerin, water, ethanol, polyol, an aqueous solution of citric acid, and a medium chain fatty acid triglyceride.

4. The manufacturing method according to claim 1, wherein:

the step (c) includes releasing the released component from the tobacco source into the vapor phase under a pressure of 0.1 MPa or less.

5. The manufacturing method according to claim 1, wherein:

in the step (c), a water content of the tobacco source before heating the tobacco source is 30 wt % or more by the wetting treatment.

6. The manufacturing method according to claim 5, wherein:

in the step (c), a water content of the tobacco source after heating the tobacco source is less than 5 wt %.

7. The manufacturing method according to claim 1, wherein:

at least one of a gum base, a tablet, an edible film, a base material, a filter, and cellulose is used as the composition element.

8. The manufacturing method according to claim 1, wherein:

the composition element is a residual tobacco source that is the tobacco source after the flavor component is released in the step (c), and the step (e) includes pouring back the predetermined solvent to the remaining tobacco source.

* * * * *